US008356386B2

(12) United States Patent
Liao

(10) Patent No.: US 8,356,386 B2
(45) Date of Patent: Jan. 22, 2013

(54) DOOR CLOSER

(75) Inventor: Jui Chung Liao, Taipei (TW)

(73) Assignee: Nan Juen International Co., Ltd., Yinge, Taipei (TW)

( * ) Notice: Subject to any disclaimer, the term of this patent is extended or adjusted under 35 U.S.C. 154(b) by 33 days.

(21) Appl. No.: 13/068,455

(22) Filed: May 11, 2011

(65) Prior Publication Data

US 2012/0284962 A1 Nov. 15, 2012

(51) Int. Cl.
*E05F 1/00* (2006.01)

(52) U.S. Cl. ..... 16/71; 16/66; 16/84; 16/DIG. 21

(58) Field of Classification Search ..... 16/49, 58, 16/66, 68, 71–72, 82, 84, 85, DIG. 9, DIG. 10, 16/DIG. 17, DIG. 21; 49/386; 188/322.15, 188/322.5
See application file for complete search history.

(56) References Cited

U.S. PATENT DOCUMENTS 4,110,868 A * 9/1978 Imazaike ..... 16/84
4,707,882 A * 11/1987 Watts ..... 16/66
4,856,625 A * 8/1989 Oshida ..... 188/282.1
4,894,883 A * 1/1990 Fleischhauer ..... 16/66
5,157,806 A 10/1992 Wartian
5,220,706 A 6/1993 Bivens
5,313,739 A 5/1994 Nelson et al.
5,471,708 A 12/1995 Lynch
5,518,223 A * 5/1996 Bivens ..... 267/34
5,706,606 A 1/1998 Lin
5,829,508 A 11/1998 DeBower et al.
6,442,796 B2 * 9/2002 Arisaka et al. ..... 16/84
6,460,839 B2 * 10/2002 Muller ..... 267/221
6,568,514 B1 * 5/2003 Tokasz ..... 188/376
6,578,832 B2 * 6/2003 Katoh ..... 267/64.11
7,367,086 B2 * 5/2008 Ito ..... 16/85
2010/0162522 A1 * 7/2010 Han et al. ..... 16/67

* cited by examiner

*Primary Examiner* — William L. Miller
(74) *Attorney, Agent, or Firm* — Charles E. Baxley

(57) ABSTRACT

A door closer includes a damping device having a cylindrical housing which has a compartment formed by an inclined inner peripheral surface and which includes a greater inner diameter at one end than the other end, a cap attached to the cylindrical housing and having an air perforation for an air to flow into and out of the cylindrical housing, a piston rod slidably engaged in the cylindrical housing, and a sleeve attached to the piston rod and having an outer diameter for engaging with the inner peripheral surface of the cylindrical housing at one end of the cylindrical housing, but not engaged with the inner peripheral surface at the other end of the cylindrical housing.

7 Claims, 7 Drawing Sheets

DOOR CLOSER

BACKGROUND OF THE INVENTION

1. Field of the Invention

The present invention relates to an air damper or door closer, and more particularly to an air damper or door closer including a simplified structure for reducing the manufacturing cost for the air damper or door closer and for allowing the air damper or door closer to be easily and quickly manufactured or assembled.

2. Description of the Prior Art

Typical air dampers or door closers or door shutting devices comprise a barrel or cylindrical housing, and a sliding rod or piston rod slidably received or engaged in the barrel or cylindrical housing and slidable between an outwardly extended working or extending position and an inwardly received storing position, and one or more spring biasing members disposed or attached or mounted or engaged into the cylindrical housing and secured or coupled between the cylindrical housing and the piston rod for recovering the piston rod back to the original position.

For example, U.S. Pat. No. 5,157,806 to Wartian, U.S. Pat. No. 5,220,7065 to Bivens, U.S. Pat. No. 5,313,739 to Nelson et al., U.S. Pat. No. 5,471,708 to Lynch, U.S. Pat. No. 5,706,606 to Lin, and U.S. Pat. No. 5,829,508 to DeBower et al. disclose several of the typical air dampers or door closers or door shutting devices each also comprising a sliding rod or piston rod slidably received or engaged in a barrel or cylindrical housing for damping or resisting the sliding movement between the cylindrical housing and the piston rod, and one or more spring biasing members disposed or engaged into the cylindrical housing and secured or coupled between the cylindrical housing and the piston rod for recovering the piston rod back to the original position.

However, the typical air dampers or door closers or door shutting devices include a complicated structure that may not be easily and quickly manufactured or assembled.

The present invention has arisen to mitigate and/or obviate the afore-described disadvantages of the conventional air dampers or door closers or door shutting devices.

SUMMARY OF THE INVENTION

The primary objective of the present invention is to provide a door closer including a simplified structure for reducing the manufacturing cost for the air damper or door closer and for allowing the air damper or door closer to be easily and quickly manufactured or assembled.

In accordance with one aspect of the invention, there is provided a door closer comprising a damping device including a cylindrical housing having a compartment formed in the cylindrical housing and defined by an inclined inner peripheral surface, the cylindrical housing including a first end and a second end, and including a greater inner diameter at the first end of the cylindrical housing and a smaller inner diameter at the other end of the cylindrical housing, a cap attached to the first end of the cylindrical housing and including an air perforation formed therein for allowing an air to flow through the air perforation of the cap and to flow into and out of the cylindrical housing, a piston rod slidably received and engaged in the compartment of the cylindrical housing, and including a first end extendible out of the second end of the cylindrical housing, and including a second end located and engaged in the compartment of the cylindrical housing, and a sleeve attached to the second end of the piston rod, and including an outer peripheral surface for engaging with the inner peripheral surface of the cylindrical housing, and including an outer diameter smaller than the inner diameter at the first end of the cylindrical housing and greater than the inner diameter at the second end of the cylindrical housing for allowing the outer peripheral surface of the sleeve to be engaged with the inner peripheral surface of the cylindrical housing at the second end of the cylindrical housing, but not engaged with the inner peripheral surface at the first end of the cylindrical housing.

The cap includes at least one recess formed therein for containing a lubricating oil therein and for retaining the lubricating oil within the compartment of the cylindrical housing. The sleeve includes at least one groove formed therein for containing a lubricating oil therein and for retaining the lubricating oil within the compartment of the cylindrical housing.

The piston rod includes at least one slot formed in the second end of the piston rod, and the sleeve includes at least one flange for engaging with the slot of the piston rod and for anchoring the sleeve to the piston rod and for preventing the sleeve from being disengaged from the piston rod.

A first member may further be provided and coupled to the cylindrical housing, and a second member may further be provided and coupled to the piston rod. One or more spring biasing members may further be provided and coupled between the first member and the second member for recovering the two members.

A filter member may further be provided and attached to the first end of the cylindrical housing for filtering the particles or dirt or containment and for preventing the dirt or containment or the particles from entering into the air perforation of the cap and for preventing the air perforation of the cap from being blocked by the dirt or containment or the particles inadvertently.

Further objectives and advantages of the present invention will become apparent from a careful reading of the detailed description provided hereinbelow, with appropriate reference to the accompanying drawings.

DETAILED DESCRIPTION OF THE PREFERRED EMBODIMENT

Figure 1:
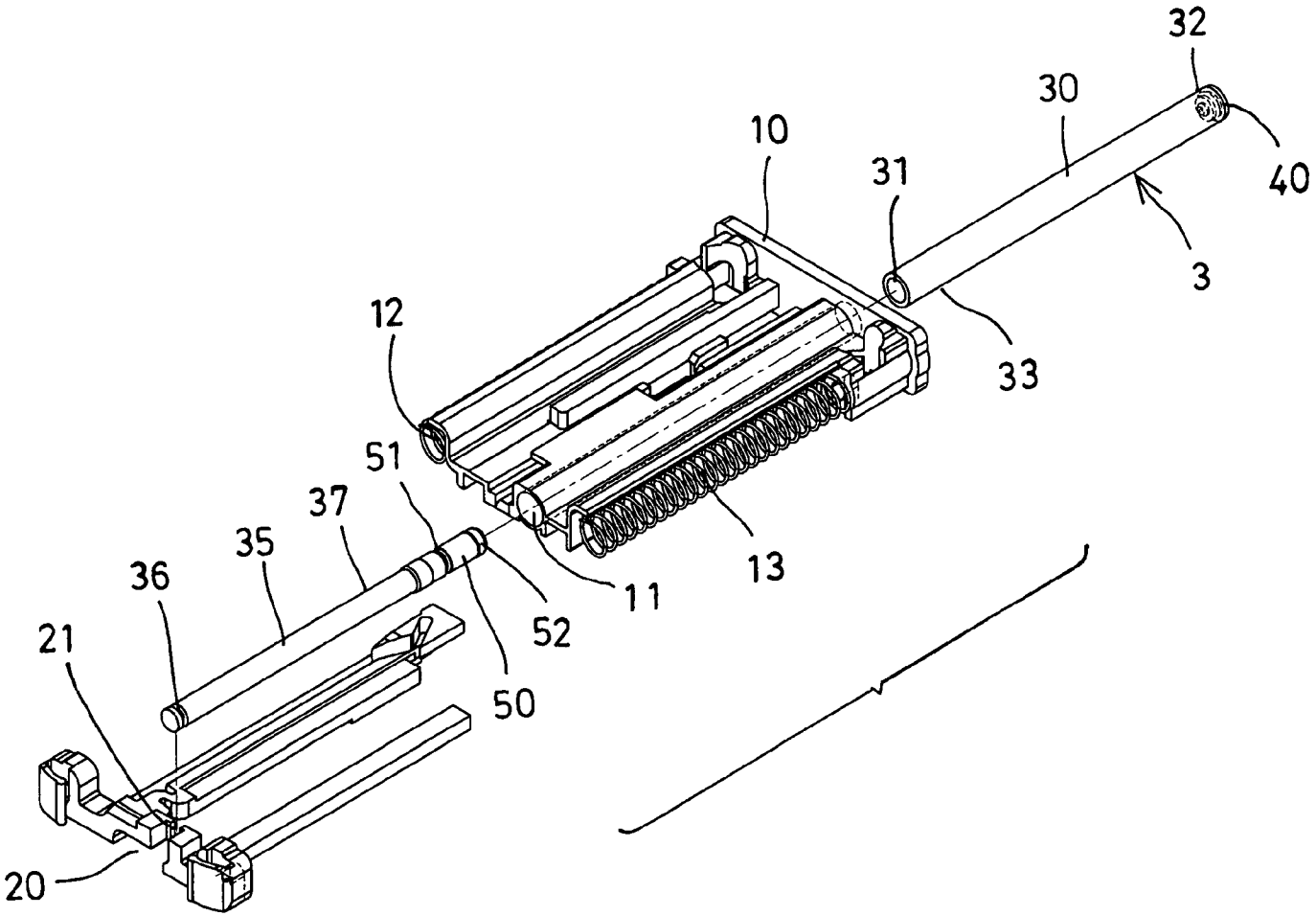
FIG. 1 is a partial exploded view of a door closer in accordance with the present invention.
Figure 2:
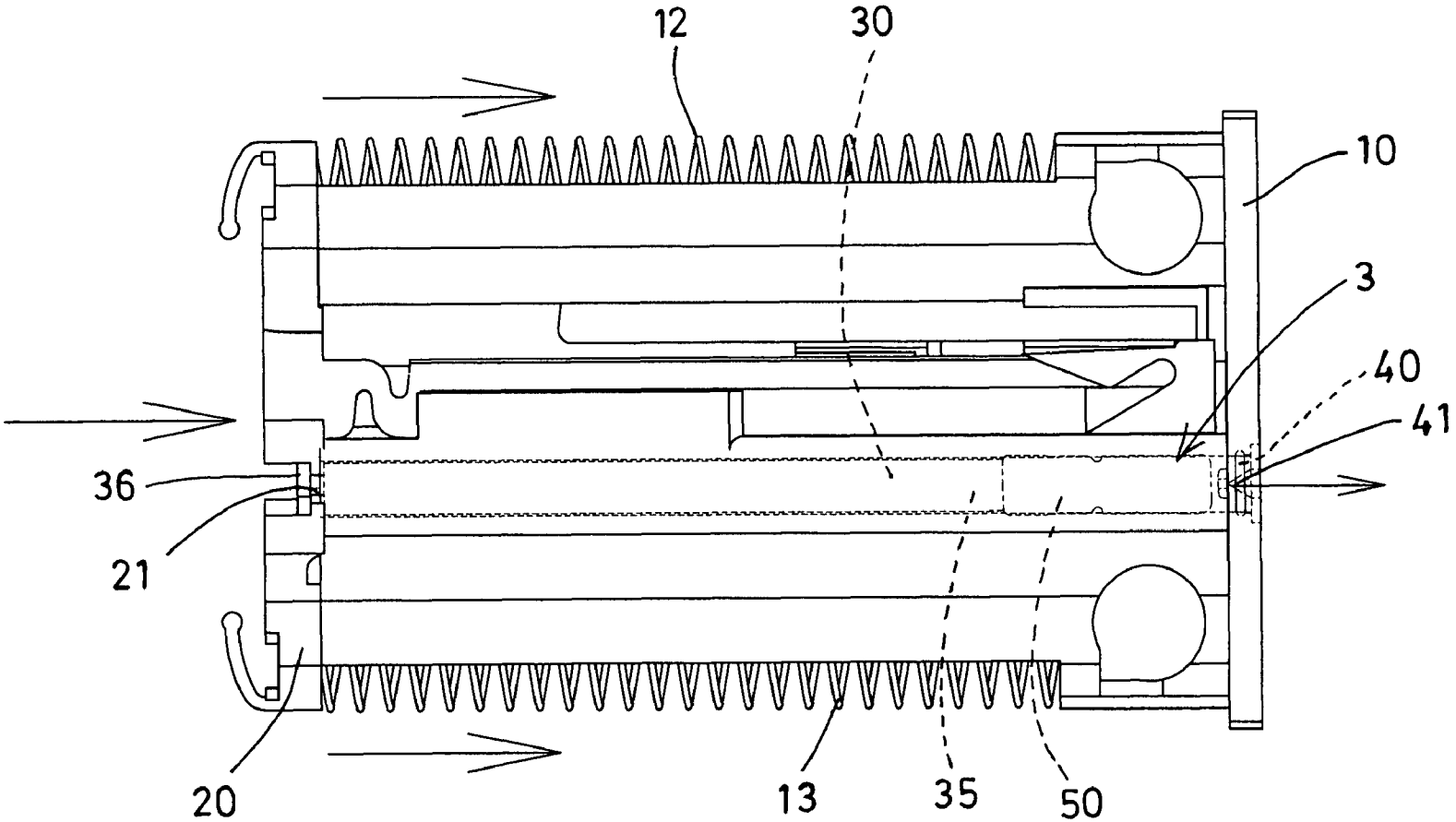
FIG. 2 is a top plan schematic view of the door closer.
Figure 3:
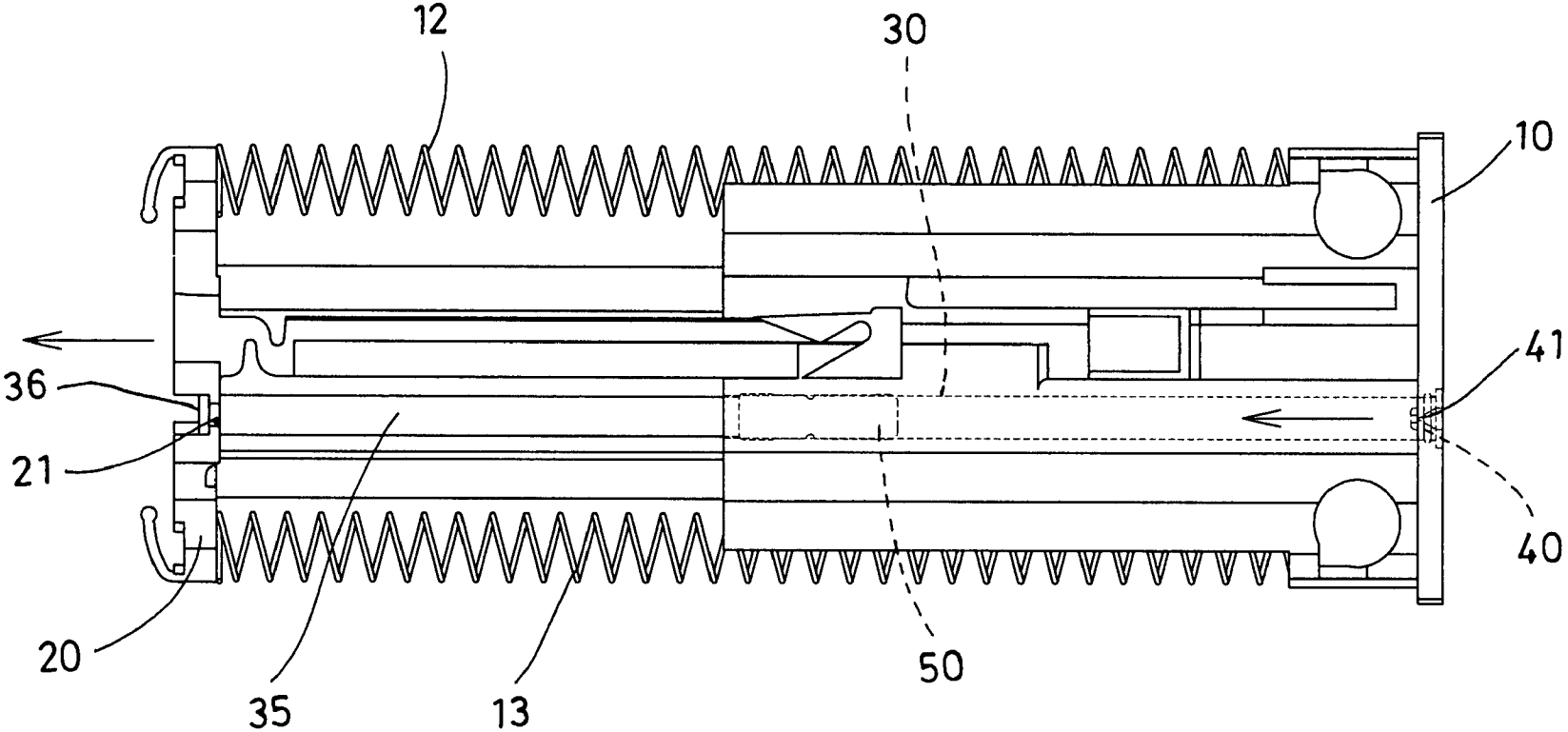
FIG. 3 is a top plan schematic view similar to FIG. 2, illustrating the operation of the door closer.
Figure 4:
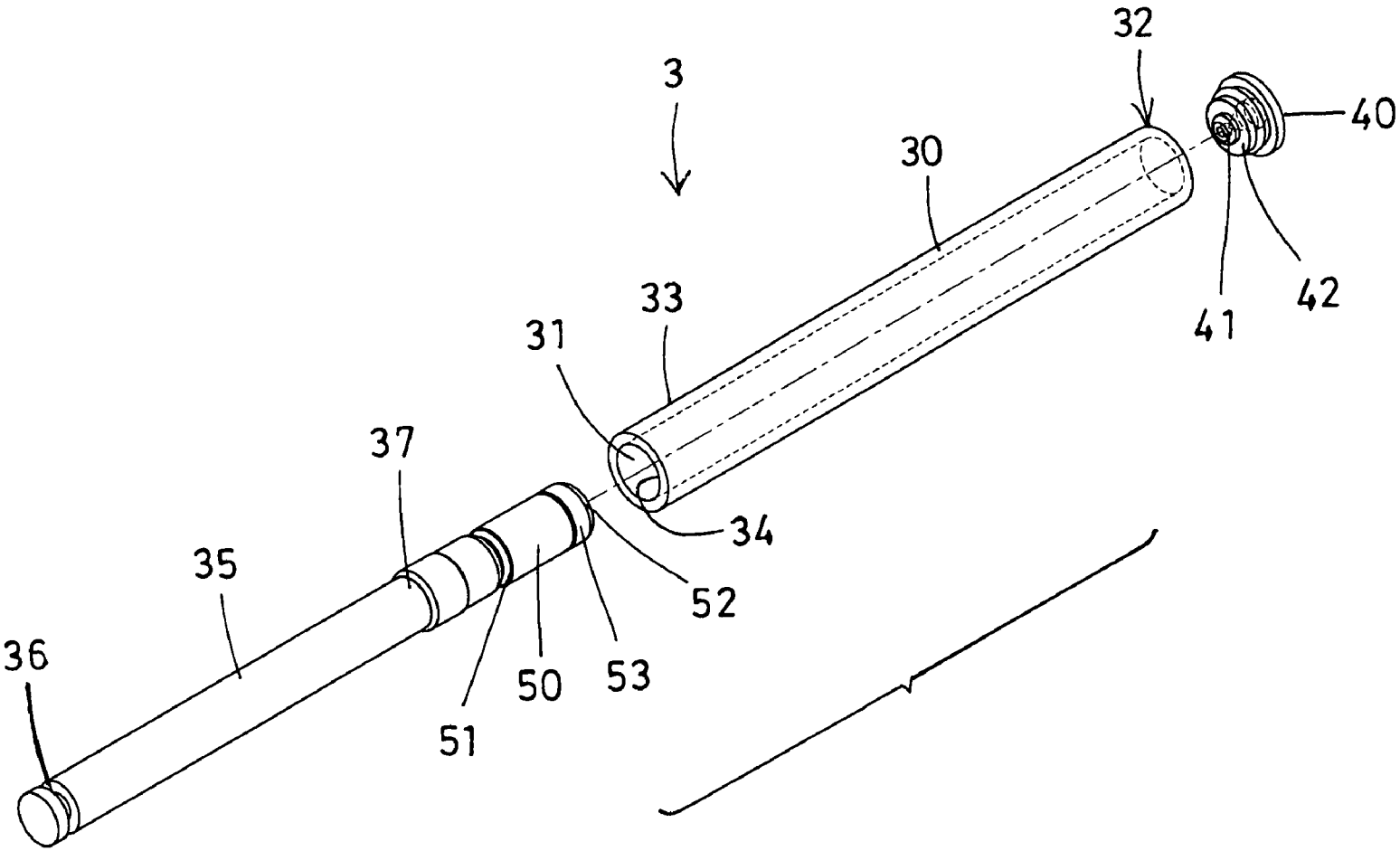
FIG. 4 is another partial exploded view of the door closer.
Figure 5:
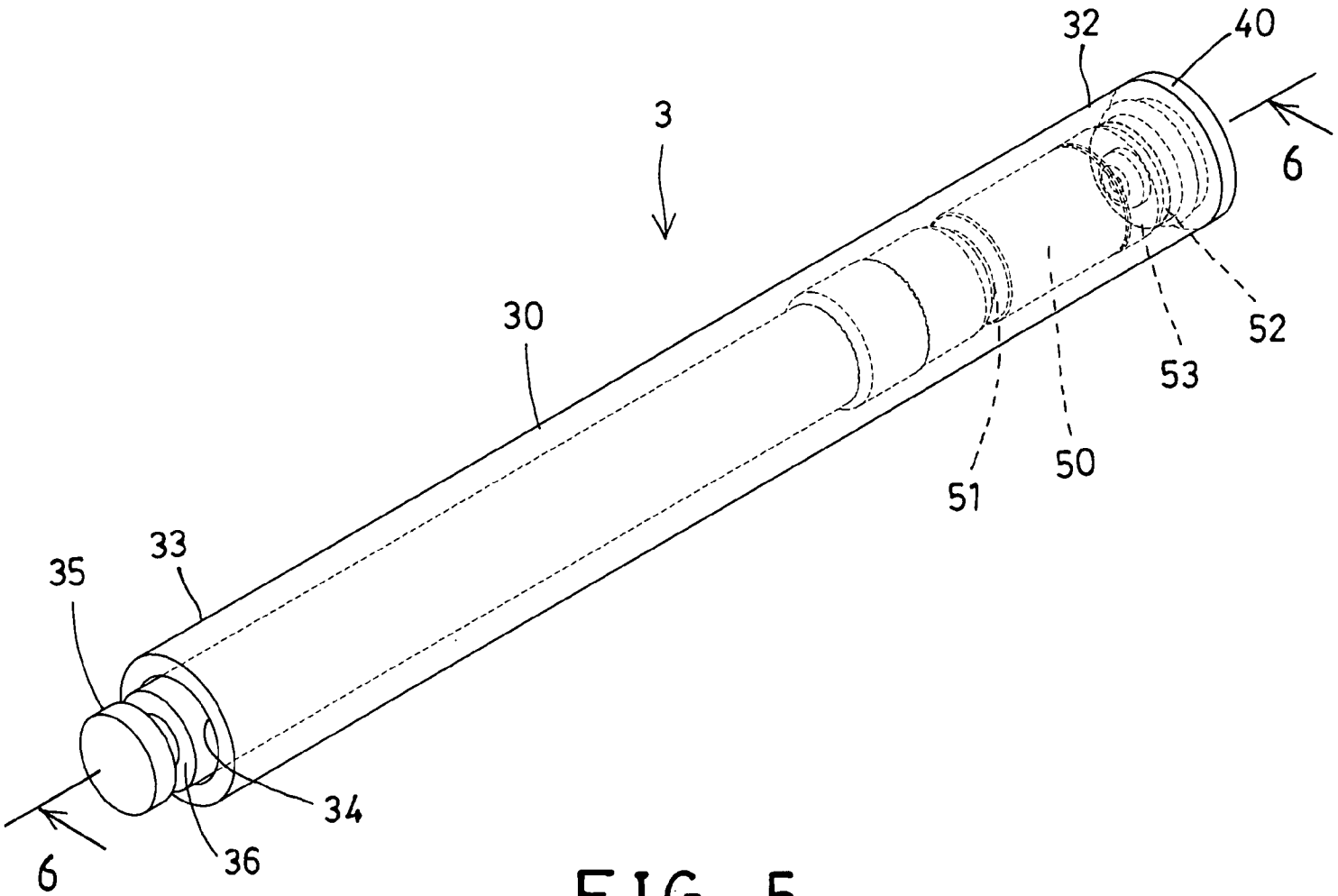
FIG. 5 is a partial perspective view of the door closer.

Referring to the drawings, and initially to FIGS. 1-3, a door closer in accordance with the present invention comprises two elements or members 10, 20, such as a first member 10 and a second member 20 slidable or movable relative to each other, and an air cushioning or damping device 3 disposed or attached or mounted or secured or coupled between the two members 10, 20 for cushioning or damping or resisting the sliding movement between the two members 10, 20. For example, the first member 10 may be the door frame 10 or the like, and the second member 20 may be the door panel 20 or the like; or the air cushioning or damping device 3 may be directly disposed or attached or mounted or secured or coupled between the door frame 10 and the door panel 20 for cushioning or damping or resisting the sliding movement between the door frame 10 and the door panel 20.

For example, the first member 10 includes a chamber 11 formed therein for receiving or attaching or mounting or securing or engaging with a barrel or cylindrical housing 30 of the air cushioning or damping device 3 which includes a bore or compartment 31 formed in the cylindrical housing 30 for slidably receiving or engaging with a primary shaft or piston rod 35, and the piston rod 35 includes one end 36 attached or mounted or secured or coupled to the second member or door panel 20 with one or more fasteners or latches 21 for allowing the piston rod 35 to be pulled or moved relative to the cylindrical housing 30 by the second member or door panel 20, and the relative sliding movement between the piston rod 35 and the cylindrical housing 30 may be used for cushioning or damping or resisting the sliding movement between the door frame 10 and the door panel 20. One or more spring biasing members 12, 13 may further be provided and attached or mounted or secured or coupled between the two members 10, 20 for biasing or recovering the two members 10, 20 back to the original position, for example.

As shown in FIGS. 4-9, a lid or cap 40 is attached or mounted or engaged or secured to one end or first end 32 of the cylindrical housing 30, and includes an air perforation 41 formed therein for allowing the air to flow through the air perforation 41 of the cap 40 and to flow into or out of the cylindrical housing 30. The cap 40 includes one or more peripheral recesses 42 formed therein for containing or retaining the grease or lubricating oil therein, and the peripheral recesses 42 of the cap 40 are communicative with the compartment 31 of the cylindrical housing 30 for supplying or retaining the grease or lubricating oil within the compartment 31 of the cylindrical housing 30 and for facilitating the sliding movement between the cylindrical housing 30 and the piston rod 35. The one end 36 or the piston rod 35 is extendible out of the other end or the second end 33 of the cylindrical housing 30 for coupling to the door panel 20.

A soft or resilient piston or sealing member or follower or gasket or sleeve 50 is attached or mounted or engaged or secured to the other end 37 of the piston rod 35 that is disposed or located or engaged in the compartment 31 of the cylindrical housing 30, and includes one or more outer peripheral grooves 51, 52 formed therein for containing or retaining the grease or lubricating oil therein and for supplying or containing or retaining the grease or lubricating oil between the cylindrical housing 30 and the piston rod 35 and also for facilitating the sliding movement between the cylindrical housing 30 and the piston rod 35. The sleeve 50 includes an outer peripheral portion or surface 53 for engaging with the inner peripheral portion or surface 34 of the cylindrical housing 30, and includes one or more peripheral ribs or flanges 55 extended radially and inwardly therefrom for engaging with the corresponding outer peripheral slots 38 that is formed in the other end 37 of the piston rod 35 and for anchoring or securing or retaining or coupling or positioning the sleeve 50 to the piston rod 35.

The inner peripheral portion or surface 34 of the cylindrical housing 30 includes a changing inner diameter gradually reduced from the one end 32 of the cylindrical housing 30 to the other end 33 of the cylindrical housing 30, or gradually increased from the other end 33 of the cylindrical housing 30 to the one end 32 of the cylindrical housing 30, or the cylindrical housing 30 includes a tapered or tilted or inclined inner peripheral portion or surface 34 having a narrower or reduced inner diameter at the other end 33 of the cylindrical housing 30 than the inner diameter at the one end 32 of the cylindrical housing 30. The sleeve 50 includes an outer diameter smaller than the inner diameter at the one end 32 of the cylindrical housing 30, but greater than the inner diameter at the other end 33 of the cylindrical housing 30 for allowing the outer peripheral portion or surface 53 of the sleeve 50 to be engaged with the inner peripheral portion or surface 34 of the cylindrical housing 30 at the other end 33 of the cylindrical housing 30, but not engaged with the inner peripheral portion or surface 34 at the one end 32 of the cylindrical housing 30.

Figure 6:
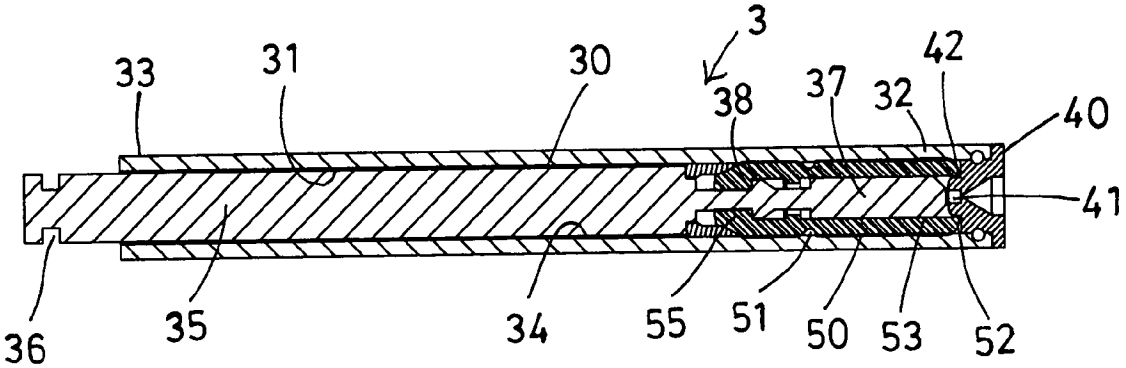
FIG. 6 is a cross sectional view of the door closer taken along lines 6-6 of FIG. 5.
Figure 7:
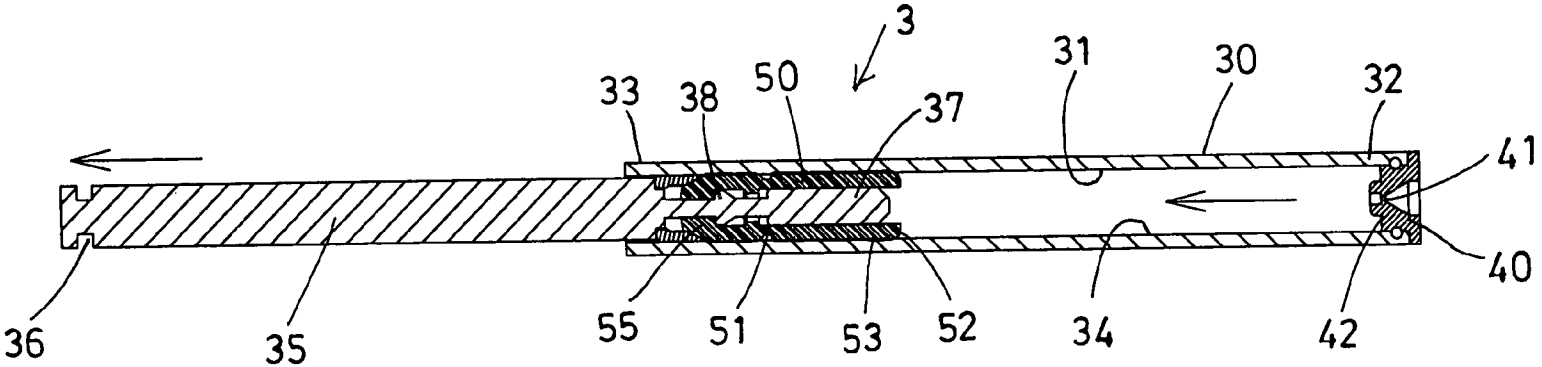
FIGS. 7, 8, 9 are cross sectional views similar to FIG. 6, illustrating the operation of the door closer.

In operation, as shown in FIGS. 6-7, when the piston rod 35 is pulled or moved out of the other end 33 of the cylindrical housing 30 or moved away from the cap 40, the outer peripheral portion or surface 53 of the sleeve 50 may be forced or caused to engage with the inner peripheral portion or surface 34 of the cylindrical housing 30 at the other end 33 of the cylindrical housing 30 for cushioning or damping or resisting the sliding movement between the cylindrical housing 30 and the piston rod 35, and at this moment, the air at the outer environment of the cylindrical housing 30 may be drawn or forced to flow through the air perforation 41 of the cap 40 and then to flow into the compartment 31 of the cylindrical housing 30.

Figure 8:
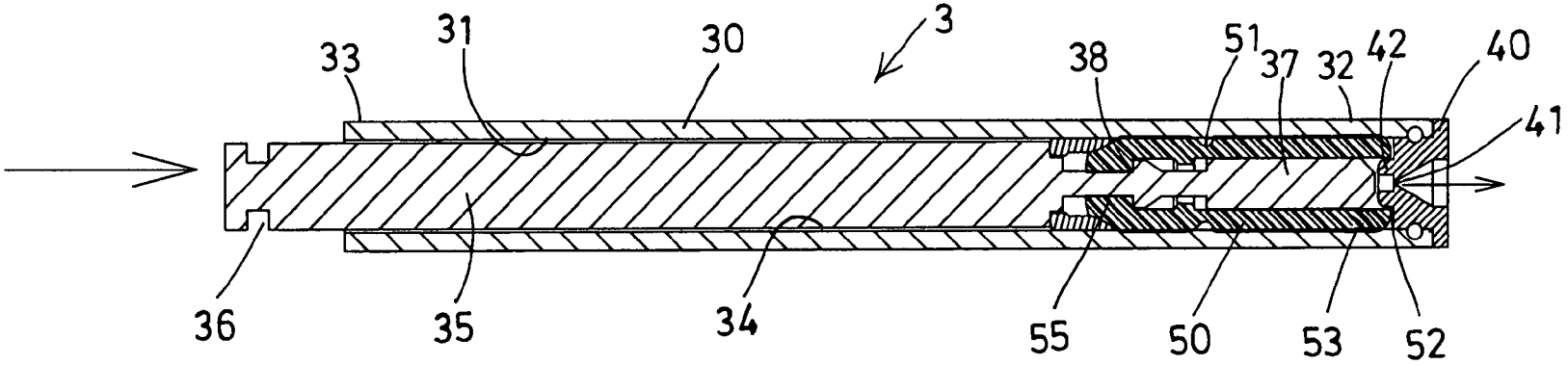
Figure 9:
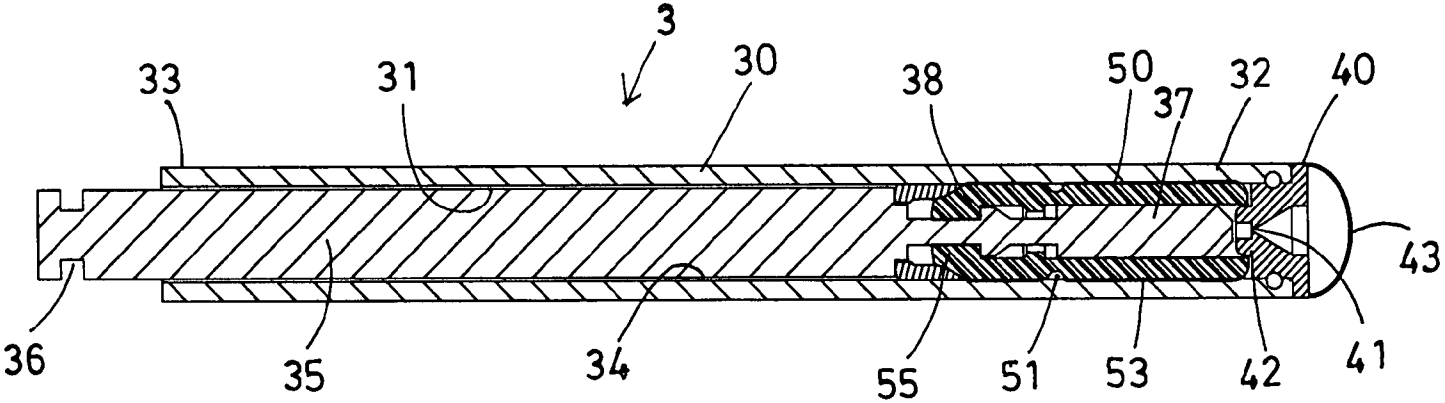

As shown in FIG. 8, when the piston rod 35 is forced or moved toward the cap 40 or the one end 32 of the cylindrical housing 30, the air contained in the compartment 31 of the cylindrical housing 30 may be forced to move or flow out through the air perforation 41 of the cap 40 and may also be used to cushion or damp or resist the sliding movement between the cylindrical housing 30 and the piston rod 35. As shown in FIG. 9, a filter screen or cover or member 43 may further be provided and attached or mounted or secured to the cap 40 or the one end 32 of the cylindrical housing 30 for filtering the particles or dirt or containment and for preventing the dirt or containment or the particles from entering into the air perforation 41 of the cap 40 and for preventing the air perforation 41 of the cap 40 from being blocked by the dirt or containment or the particles inadvertently.

It is to be noted that the sleeve 50 may be easily and quickly manufactured and may be easily and quickly assembled onto the other end 37 of the piston rod 35, and the cap 40 may also be easily and quickly manufactured and may be easily and quickly assembled or engaged onto the one end 32 of the cylindrical housing 30, and the flowing or the air from the compartment 31 of the cylindrical housing 30 through the air perforation 41 of the cap 40 may be used to cushion or damp or resist the sliding movement between the cylindrical housing 30 and the piston rod 35, and the sliding engagement between the outer peripheral portion or surface 53 of the sleeve 50 and the inner peripheral portion or surface 34 of the cylindrical housing 30 at the other end 33 of the cylindrical housing 30 may also be used to cushion or damp or resist the sliding movement between the cylindrical housing 30 and the piston rod 35. No spring biasing members are required to be disposed or attached or mounted or engaged into the cylindrical housing 30 and secured or connected or coupled between the cylindrical housing 30 and the piston rod 35.

Accordingly, the door closer in accordance with the present invention includes a simplified structure for reducing the manufacturing cost for the air damper or door closer and for allowing the air damper or door closer to be easily and quickly manufactured or assembled.

Although this invention has been described with a certain degree of particularity, it is to be understood that the present disclosure has been made by way of example only and that numerous changes in the detailed construction and the combination and arrangement of parts may be resorted to without departing from the spirit and scope of the invention as hereinafter claimed.

I claim:

1. A door closer comprising:

a damping device including a cylindrical housing having a compartment formed in said cylindrical housing and defined by an inclined inner peripheral surface, said cylindrical housing including a first end and a second end, and including a greater inner diameter at said first end of said cylindrical housing and a smaller inner diameter at said second end of said cylindrical housing, a cap attached to said first end of said cylindrical housing and including an air perforation formed therein for allowing an air to flow through said air perforation of said cap and to flow into and out of said cylindrical housing, a piston rod slidably received and engaged in said compartment of said cylindrical housing, and including a first end extendible out of said second end of said cylindrical housing, and including a second end located and engaged in said compartment of said cylindrical housing, and a sleeve attached to said second end of said piston rod, and including an outer peripheral surface for engaging with said inner peripheral surface of said cylindrical housing, and including an outer diameter smaller than the inner diameter at said first end of said cylindrical housing and greater than the inner diameter at said second end of said cylindrical housing for allowing said outer peripheral surface of said sleeve to be engaged with said inner peripheral surface of said cylindrical housing at said second end of said cylindrical housing, but not engaged with said inner peripheral surface at said first end of said cylindrical housing.

2. The door closer as claimed in claim 1, wherein said cap includes at least one recess formed therein for containing a lubricating oil therein and for retaining the lubricating oil within said compartment of said cylindrical housing.

3. The door closer as claimed in claim 1, wherein said sleeve includes at least one groove formed therein for containing a lubricating oil therein and for retaining the lubricating oil within said compartment of said cylindrical housing.

4. The door closer as claimed in claim 1, wherein said piston rod, includes at least one slot formed in said second end of said piston rod, and said sleeve includes at least one flange for engaging with said at least one slot of said piston rod and for anchoring said sleeve to said piston rod.

5. The door closer as claimed in claim 1 further comprising a first member coupled to said cylindrical housing, and a second member coupled to said piston rod.

6. The door closer as claimed in claim 5 further comprising at least one spring biasing member coupled between said first member and said second member.

7. The door closer as claimed in claim 1 further comprising a filter member attached to said first end of said cylindrical housing.

* * * * *